US005534085A

United States Patent [19]

Cone et al.

[11] Patent Number: 5,534,085

[45] Date of Patent: Jul. 9, 1996

[54] LOW TEMPERATURE FORGING PROCESS FOR FE-NI-CO LOW EXPANSION ALLOYS AND PRODUCT THEREOF

[75] Inventors: Fred P. Cone, Jupiter; Stephen V. Prece, Palm Beach Gardens, both of Fla.; Donn A. Best, Alta Loma, Calif.

[73] Assignee: United Technologies Corporation, Hartford, Conn.

[21] Appl. No.: 233,789

[22] Filed: Apr. 26, 1994

[51] Int. Cl.[6] ..... C22C 38/52; C22C 30/00; C21D 8/00

[52] U.S. Cl. ..... 148/336; 148/328; 148/419; 148/707; 148/649

[58] Field of Search ..... 148/649, 707, 148/419, 328, 336; 420/95, 581

[56] References Cited

U.S. PATENT DOCUMENTS

| | | | |
|---|---|---|---|
| 3,359,094 | 12/1967 | Bieber et al. | 75/123 |
| 3,642,543 | 2/1972 | Owczarski et al. | 148/12.7 |
| 3,705,827 | 12/1972 | Muzyka et al. | 148/419 |
| 3,857,741 | 12/1974 | Hultgren et al. | 148/36 |
| 3,889,510 | 6/1975 | Yamakoshi et al. | 72/364 |
| 4,066,447 | 1/1978 | Smith, Jr. et al. | 75/122 |
| 4,445,944 | 5/1984 | Smith, Jr. et al. | 148/419 |
| 4,591,393 | 5/1986 | Kane et al. | 148/11.5 |
| 4,644,776 | 2/1987 | Berchem | 72/364 |
| 5,059,257 | 10/1991 | Wanner et al. | 148/12.3 |
| 5,080,727 | 1/1992 | Aihara et al. | 148/11.5 |
| 5,087,415 | 2/1992 | Hemphill et al. | 420/95 |
| 5,236,522 | 8/1993 | Fukuda et al. | 148/336 |

FOREIGN PATENT DOCUMENTS

| | | | |
|---|---|---|---|
| 2043704 | 8/1974 | Germany | 420/95 |
| 1416264 | 12/1975 | United Kingdom | 420/95 |

OTHER PUBLICATIONS

M. A. Holderby, D. F. Smith, and F. P. Cone, *Process Sensitivities In Incoloy® alloy 909—Effect and Control*, Apr. 1991, pp. 1–19.

*Primary Examiner*—Deborah Yee
*Attorney, Agent, or Firm*—Popham, Haik, Schnobrich & Kaufman, Ltd.

[57] ABSTRACT

A method of treating low-expansion Fe—Ni—Co superalloys is disclosed in which the alloys are forged at a temperature below the recrystallization temperature and then recrystallized without the use of intervening annealing steps. It is necessary that the warm forging step introduce sufficient strain throughout the Fe—Ni—Co superalloy such that after recrystallizing, the superalloy has a substantially uniform microstructure. Alloys produced by this method exhibit good hydrogen charging embrittlement resistance, good strength and/or rupture ductility in moist air.

23 Claims, 5 Drawing Sheets

LOW TEMPERATURE FORGING PROCESS FOR FE-NI-CO LOW EXPANSION ALLOYS AND PRODUCT THEREOF

BACKGROUND OF THE INVENTION

Field of the Invention

The present invention relates to a method of forging low expansion Fe—Ni—Co alloys to produce articles having uniform microstructure with various combinations of hydrogen resistance, good strength, and rupture ductility in moist air.

INTRODUCTION

In certain high technology applications, especially in the aerospace area, there has arisen a need for materials which exhibit: 1) hydrogen charging embrittlement resistance, 2) uniform microstructure, 3) good strength, 4) low expansion behavior, and/or 5) rupture ductility in moist atmospheres. Fe—Ni—Co alloys, such as those described in U.S. Pat. No. 4,066,447, are well known low expansion superalloys. (All references cited herein are incorporated by reference as if reproduced in full.) While these superalloys have been found to be valuable materials, current methods of shaping these alloys often do not reproducibly result in articles having uniform microstructure, and these articles often exhibit less than optimal characteristics in one or more of the above-listed five properties.

A particularly important Fe—Ni—Co superalloy is known by the tradename INCOLOY™ 909. Current forging practices for INCOLOY™ 909 articles rely on high temperature (i.e. at least 1800° F.) annealing cycles between forging deformation operations. See "INCOLOY alloy 909," Publication No. IAI-18, Inco Alloys International, Inc. 1987. These anneal cycles soften the metal and reheat the alloy making material movement easier during the next working operation. These anneals effectively release most strains as the metal recrystallizes. Additionally, cooling during forging may cause undesirable thermal gradients in which the interior of the article being forged is significantly hotter than the exterior and thus lead to different microstructures in the forged article.

The recrystallization behavior of INCOLOYυ 909 is sensitive to prior forging strain and the temperature at which forging strain occurs. The non-uniform strains and temperature gradients which naturally occur during forging can set the stage for non-uniform recrystallization/microstructure response. Unfortunately, it is a practical impossibility to achieve uniform strains when forging. This is especially true for final forging operations where relatively light forging strains are typically used to produce the minimum material envelope necessary to meet the drawing shape. As a result, INCOLOY™ 909 forgings, especially those heavier section parts such as bellows and heat shields, have exhibited inconsistent structure. Hardware cracking has been attributed to hydrogen charging embittlement. The microstructure of INCO 909 can directly influence the alloy's resistance to hydrogen. Microstructures having poor hydrogen resistance can be weaker and less ductile than more resistant forms. Furthermore, a form of INCOLOY™ 909 that exhibits both hydrogen charging resistance and rupture ductility in moist environments has not been identified.

OBJECTS OF THE INVENTION

It is an object of the present invention to provide a method for making a low expansion Fe—Ni—Co superalloy having a substantially uniform microstructure.

It is another object of the present invention to provide a method of using warm forging to uniformly disperse a precipitate phase in an Fe—Ni—Co alloy.

It is a further object of the present invention to provide a method for treating a low expansion Fe—Ni—Co alloy to provide hydrogen charging resistance and durability in moist environments.

It is yet another object of the present invention to provide a low expansion Fe—Ni—Co superalloy having uniform microstructure.

SUMMARY OF THE INVENTION

The present invention provides a method of making a low expansion Fe—Ni—Co superalloy having a substantially uniform microstructure by warm forging at a temperature below the recrystallization temperature of the superalloy followed by a heat treatment step conducted at a temperature above the recrystallization temperature of the superalloy. The recrystallization heat treatment step followed by cooling, results in precipitation of a high temperature precipitate phase. After the recrystallization heat treatment, the superalloy is strengthened by an aging step which creates a very fine (relative to the high temperature precipitate phase) $\gamma$ precipitate phase. It is a requirement of the present invention that the warm forging step introduces sufficient strain throughout the superalloy workpiece such that after the recrystallizing step, the alloy has a substantially uniform microstructure. Without introducing sufficient strain throughout the superalloy, it is not possible to reproducibly achieve a uniform microstructure in the final material. For purposes of the present invention, the term substantially uniform microstructure means that there is not a pronounced segregation of areas having fine and coarse grain sizes, and the structure is predominantly recrystallized, when comparing various locations of an article forged according to the methods of the present invention. The degree of uniformity of microstructure resulting from the methods of the present invention will vary depending on the shape and size of the article produced, and therefore the degree of uniformity is difficult to quantify; however, in a preferred embodiment, various locations of an article vary in grain size by three ASTM grain size numbers or less.

The method of the present invention may include multiple forging steps; however, since the method of the present invention requires the buildup of strain throughout the superalloy, the superalloy should not be annealed to relieve strain during or between the warm forging steps. The forging step or steps should be conducted at temperatures between about 1200° F. to about 1700° F. In a preferred embodiment forging is conducted between 1550° F. and 1650° F. In a particularly preferred embodiment, warm forging is conducted at about 1600° F. In a preferred embodiment the superalloy workpiece receives at least about 30% strain.

The recrystallization heat treatment should be conducted at a temperature between about 1800° F. to about 1950° F. It is crucial that the forging operation introduce sufficient strain throughout the superalloy so that after recrystallizing, the superalloy has a substantially uniform microstructure. Within the foregoing critical requirement, the time of the recrystallization heat treatment is not critical; however, in a preferred embodiment the recrystallization time is contemplated to be between about 0.5 and 4 hours. In a more preferred embodiment, recrystallization is conducted at about 1850° F. for about 1 hour.

For applications requiring good strength and hydrogen resistance, it is desirable that the recrystallizing heat treatment conditions be selected to fully recrystallize the alloy. Subsequent aging treatment of the fully recrystallized alloy results in an alloy having a precipitate phase that is substantially uniformly distributed throughout the alloy. As illustrated in the figures, these alloys do not have a substantial amount of high temperature precipitate accumulating at the grain boundaries. Furthermore, these alloys do not have substantial grain boundary films (i.e. laves). The lack of laves is a particularly advantageous feature of the present invention, since materials with grain boundary films are especially susceptible to hydrogen charging embrittlement. Examples of acceptable and unacceptable microstructures are illustrated in FIGS. 1A–6B.

The uniform dispersal of the high temperature precipitate phase (i.e. laves) throughout the alloy, which results from the process of the present invention in which the alloy is fully recrystallized, is believed to be a result of two factors. First, the complete recrystallization in the final solution anneal leads to the establishment of new grain boundaries in the matrix. Second, the low forging temperatures applied throughout this process help reduce precipitation of the high temperature phases during forging and prevents the development of a stable grain pinning network that constrains recrystallization. When recrystallizing grains are pinned, heavily decorated grain boundaries detrimental to performance in hydrogen are left behind. If full recrystallization is not conducted, then remnant unrecrystallized grains will be decorated with a detrimental high temperature precipitate phase concentration.

For applications requiring good rupture ductility, without concern for hydrogen embrittlement, it is sometimes preferred that the recrystallizing heat treatment does not fully recrystallize the alloy. Subsequent aging treatment causes the unrecrystallized grains to overage, resulting in a softer material which readily deforms when exposed to creep conditions. However, less than full recrystallization during the recrystallizing step is sometimes undesirable since overaging also results in precipitation at the grain boundaries, and a reduction in hydrogen resistance.

In a preferred embodiment, the alloy resulting from the recrystallization heat treatment step is cooled at a rate equivalent to air cool. It is also preferred that the alloys resulting from the recrystallization heat treatment be subjected to an aging treatment. In a preferred embodiment the superalloys resulting from the recrystallization heat treatment are strengthened by heating to 1325° F. for about 8 hours, then cooled at a rate of about 100° F. per hour to 1150° F. and held at this temperature for about 8 hours followed by cooling at a rate equivalent to air cool. The moist stress rupture ductility of the superalloy can be increased by increasing the temperature and time aging. Thus, in another preferred embodiment, the superalloy is age strengthened at 1375° F. for 4 to 8 hours and about 1150° F. for about 8 hours.

Because different alloys will react differently to identical forging treatments, the composition of the alloy to be treated according to the methods of present invention is also important. The term Fe—Ni—Co superalloys, as it is used in the present invention, refers to low expansion Fe—Ni—Co superalloys as they are understood and defined in the prior art. Thus, Fe—Ni—Co superalloys which can be beneficially forged according to the methods of the present invention include those described in U.S. Pat. Nos. 4,066,447 and 5,059,257. Fe—Ni—Co superalloys, as the term is defined in the present invention, does not encompass all materials which contain these three elements. For example, methods of the present invention exclude the treatment of materials such as: low alloy steels, maraging steels, and martensitic steels, which all rely on carbon related phase transformations for principal strengthening mechanisms to occur. In a preferred embodiment, alloys of the present invention have the composition set forth in Table 1.

TABLE 1

Preferred Composition of Alloy of Present Invention
Weight %

| | min | max |
|---|---|---|
| Carbon | — | 0.06 |
| Manganese | — | 1.00 |
| Silicon | 0.25–0.50 | |
| Phosphorus | — | 0.015 |
| Sulfur | — | 0.015 |
| Nickel | 35.00–40.00 | |
| Cobalt | 12.00–16.00 | |
| Columbium + Tantalum | 4.30–5.20 | |
| Titanium | 1.35–1.80 | |
| Boron | — | 0.012 |
| Chromium | — | 1.00 |
| Aluminum | — | 0.15 |
| Copper | — | 0.50 |
| Iron | remainder[1] | |

[1]wherein remainder is essentially the balance of the material.

In another preferred embodiment the alloy used in the present invention is INCOLOY™ 909 (Fe-38% Ni-13% Co-4.7% Nb-1.5% Ti-0 4% Si-0.03% Al-0.01% C)

Alloys produced by methods of the present invention are especially useful in situations requiring low expansion, high strength and good hydrogen resistance. The alloys can be machined to the desired shape. Parts made of alloys of the present invention are especially well-suited for operating in hydrogen-containing environments at temperatures up to 1200° F. with limited exposure up to 1350° F. Methods and alloys of the present invention are particularly useful for making parts such as bellows and heat shields for rocket engine turbopumps and other parts such as support rings and cases in gas turbine engines.

DETAILED DESCRIPTION OF THE INVENTION

Figure 1A:
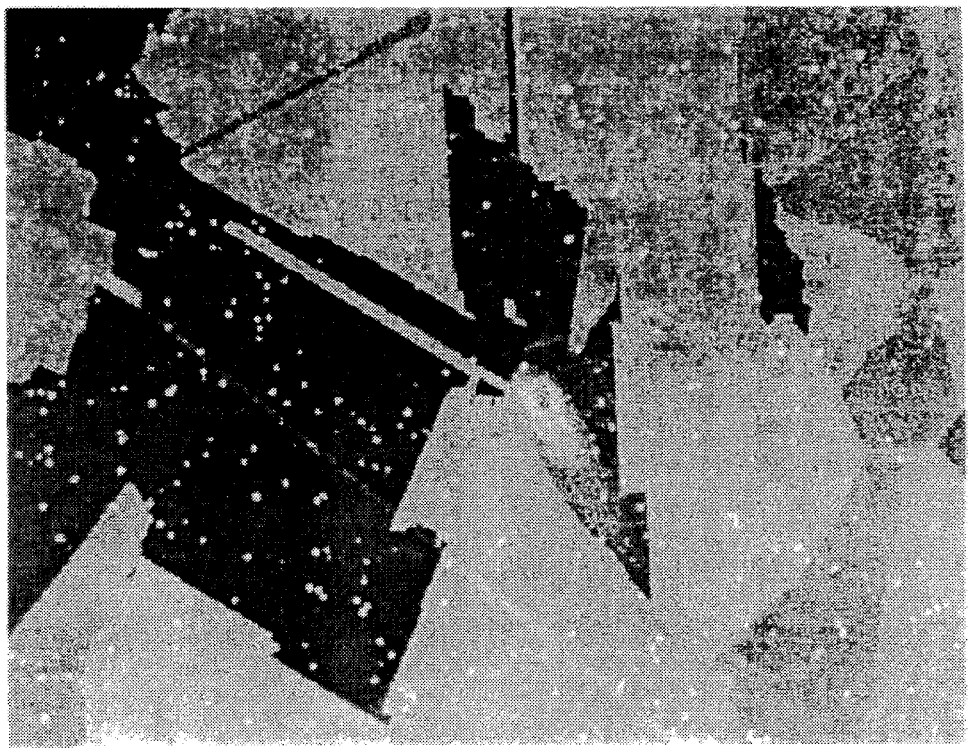
FIG. 1A illustrates a microstructure, acceptable for use in hydrogen-containing environments, exhibiting complete recrystallization and precipitates (white particles) substantially uniformly dispersed throughout the matrix. The etchant is sulfide stain; 500× magnification.

Forging methods and heat treatment steps of the present invention have been described above. More detailed descriptions of particular embodiments of the present invention are described below.

Low-expansion Fe—Ni—Co superalloys are forged at temperatures between about 1200° F. to about 1700° F. such that strain is introduced throughout the superalloy workpiece. In order to induce sufficient strain throughout the workpiece, there should not be any annealing steps which cause recrystallization between the forging steps. In a preferred embodiment, the forging step or steps are conducted between 1550° F. and 1650° F.

Recrystallization of the alloy during forging is undesirable. Therefore, forging should not be conducted at so fast a rate as to cause adiabatic heating and recrystallization of the alloy. It is preferred that at least about 30% strain is introduced by the forging step or steps. The forged workpiece is then subjected to a recrystallization treatment at a temperature between about 1800° F. to about 1950° F. In a preferred embodiment the recrystallization step is conducted at about 1800° F. to 1900° F. for about 1 hour. In a preferred embodiment, the superalloy is precipitation hardened by a precipitation heat treatment conducted at about 1325°±25° F. for about 8 hours followed by a furnace cool at a rate of about 100°±25° F. to 1150°±25° F. and held at about 1150°±25° F. for about 8 hours, followed by air cool.

The improvement in hydrogen resistance that is accomplished in preferred embodiments of the present invention is demonstrated by comparing the alloys which result from the present process versus alloys that result from a prior art process. In a preferred embodiment of the present process, INCOLOY™ 909 was forged at about 1600° F. and fully recrystallized at about 1850° F., and was then subjected to a precipitation hardening step as described in Example 1. A comparison sample was prepared by subjecting an INCOLOY™ 909 sample to multiple forging steps at about 1875° F. The data shown below illustrates the strength of the compared samples before and after exposure to 5000 psi hydrogen at 800° F. for one hour.

| Notch Strength at RT (ksi) | Before Exposure | After Exposure |
|---|---|---|
| Prior art process | 225 | 128 |
| Process of present invention | 263 | 200 |

It is preferred that superalloys processed by the methods of the present invention exhibit the following properties:

Tensile Properties:

Tensile Properties provided throughout this disclosure were measured at a strain rate of between 0.003 to 0.007 inch per inch per minute through yield strength and then increased to produce failure in approximately 1 additional minute, unless indicated otherwise;

At −320° F.:

Superalloys made by the process of the present invention have the following minimum values; for notch tensile testing a crosshead speed of approximately 0.05 inch per minute shall be maintained:

| | |
|---|---|
| Notch tensile strength, $K_t$ = 3.0 | 245 ksi |
| Tensile strength | 220 ksi |
| Yield strength at 0.2% offset | 160 ksi |
| Elongation (length 4 × diameter) | 9% |
| Reduction of area | 10% |

At room temperature:

The following indicate minimum values; measured according to ASTM E8:

| | |
|---|---|
| Tensile strength | 175 ksi |
| Yield strength at 0.2% offset | 140 ksi |
| Elongation in 4D | 8% |
| Reduction of area | 12% |

At 1200° F.:

The following minimum values are measured in accordance with ASTM E21 on specimens heated to 1200°±5° F. and held at heat for 20 minutes before testing:

| | |
|---|---|
| Tensile strength | 135 ksi |
| Yield strength at 0.2° offset | 105 ksi |
| Elongation in 4D | 10% |
| Reduction of area | 15% |

Hardness:

At least 331 HB.

Thermal expansion:

Mean linear thermal expansion should be no higher than $4.5\times10^{-6}$ in./in./°F. from room temperature to 780° F., determined in accordance with ASTM E228.

Stress rupture properties at 1000° F.:

Testing and specimen dimensional requirements shall conform to the requirements of ASTM E292 except as noted below. A standard cylindrical combination smooth-and-notched or a separate notch specimen is maintained at 1000°±5° F. while a load sufficient to produce an initial axial stress of 70 ksi is applied continuously. The environment for testing should be controlled to temperatures in the range between 70° to 80° F. at a relative humidity of at least 50%. Rupture in either the smooth or notch region of the specimens is permissible. The specimens should not rupture in less than 32 hours.

Grain size:

Grain size should be ASTM 3 or finer with isolated grains as large as ASTM 2 determined in accordance with ASTM E112 and ASTM E930. It is preferred that grain size be continuously uniform without pronounced segregation of fine and coarse areas when comparing various locations. In a more preferred embodiment grain size should be ASTM 6 or finer.

Figure 1B:
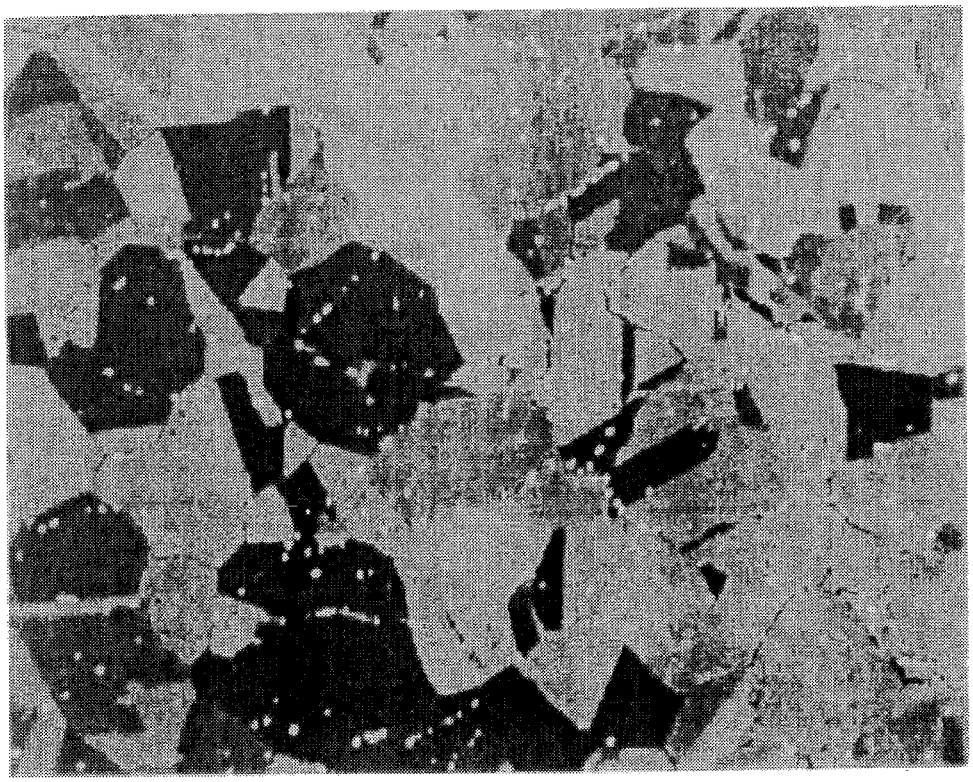
FIG. 1B illustrates a microstructure, acceptable for use in hydrogen-containing environments, exhibiting a fine grain size and precipitates that are predominantly dispersed to the grain interiors. The etchant is sulfide stain; 500× magnification.
Figure 2:
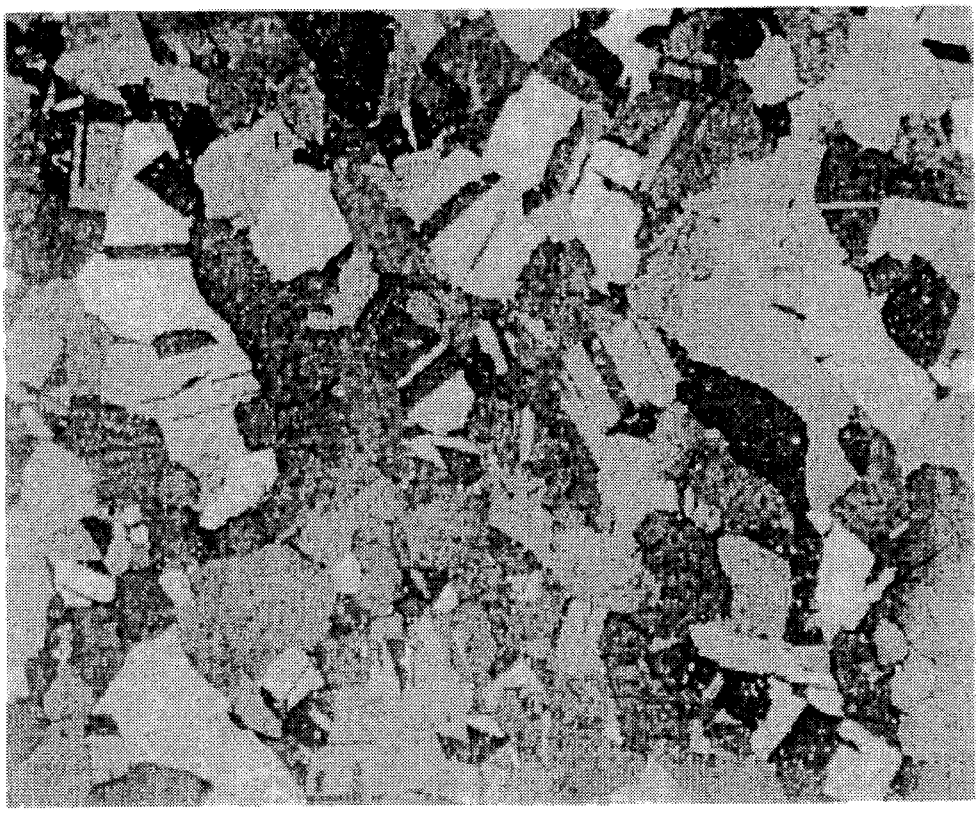
FIG. 2 illustrates a microstructure, acceptable for use in hydrogen-containing environments, exhibiting fine recrystallized grains and precipitates that are substantially uniformly dispersed throughout the matrix. The etchant is sulfide stain; 500× magnification.
Figure 3:
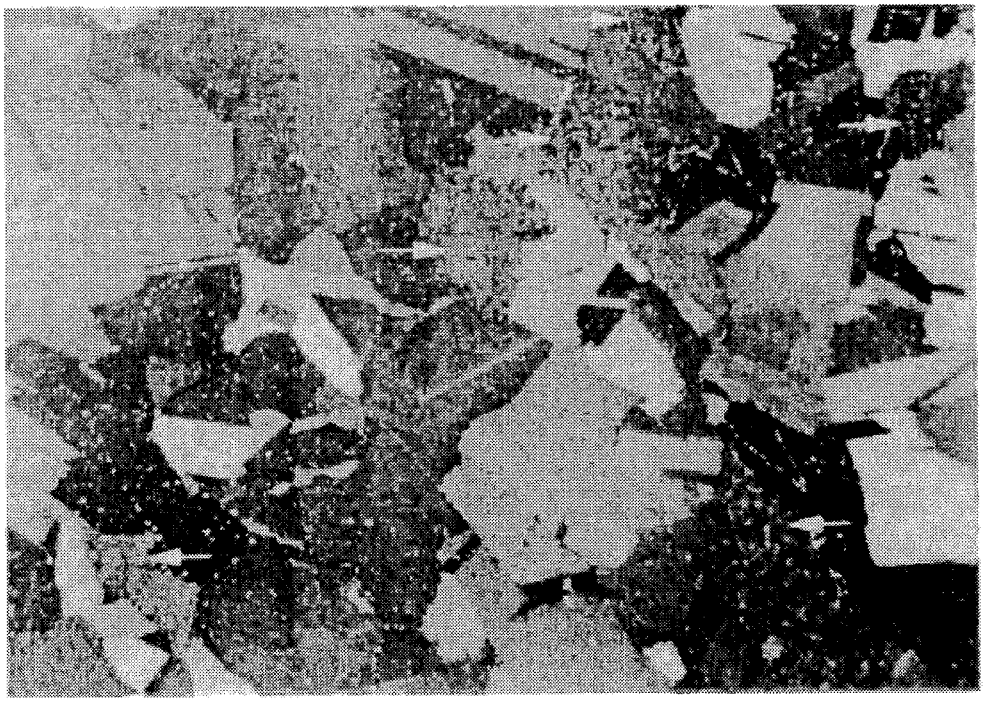
FIG. 3 illustrates a microstructure, acceptable for use in hydrogen-containing environments, exhibiting predominantly recrystallized grains with occasional unrecrystallized overaged grains (rough textured appearance, arrows). Precipitates are substantially uniformly dispersed but occasionally reside in grain boundaries. The etchant is sulfide stain; 500× magnification.
Figure 4:
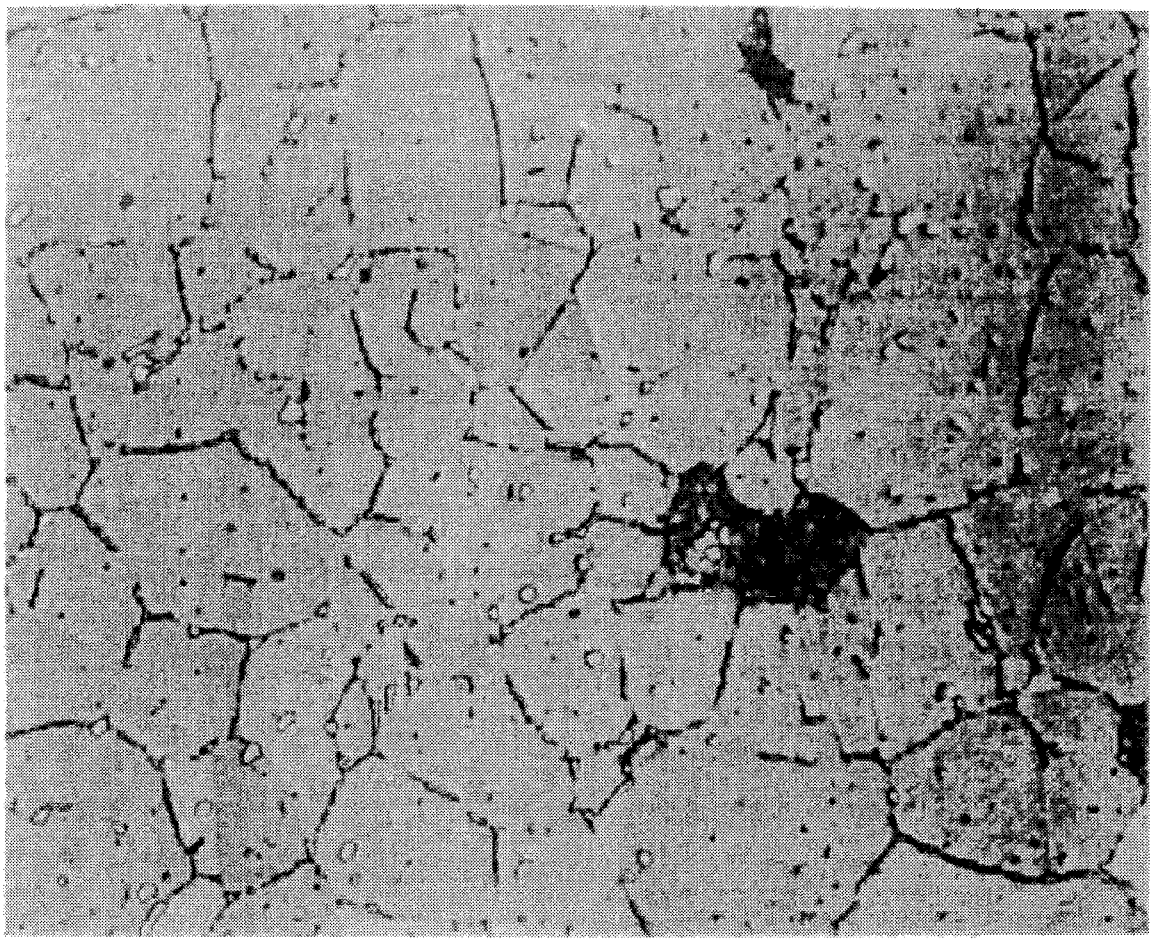
FIG. 4 illustrates a microstructure that is unacceptable for use in hydrogen-containing environments. Although the sample is predominantly recrystallized and fine-grained, there is heavy grain boundary decoration by precipitate particles. The etchant is Kallings; 1000× magnification.
Figure 5A:
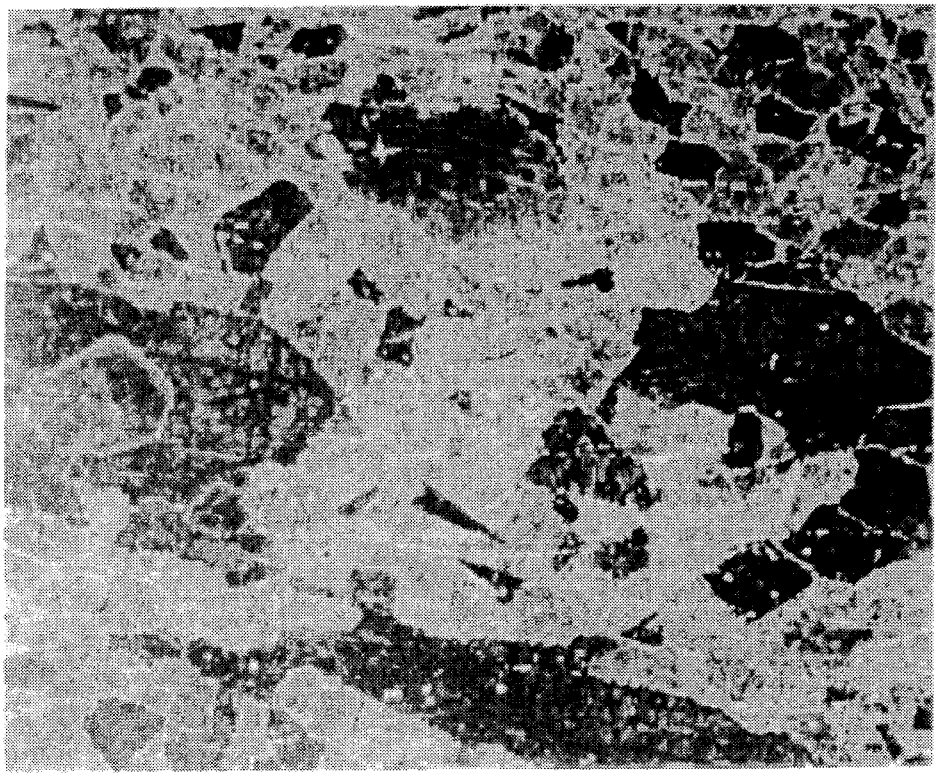
FIG. 5A illustrates a microstructure, unacceptable for use in hydrogen-containing environments, exhibiting completely unrecrystallized heavily overaged grains with heavy grain boundary precipitate decoration. The etchant is sulfide stain; 500× magnification.
Figure 5B:
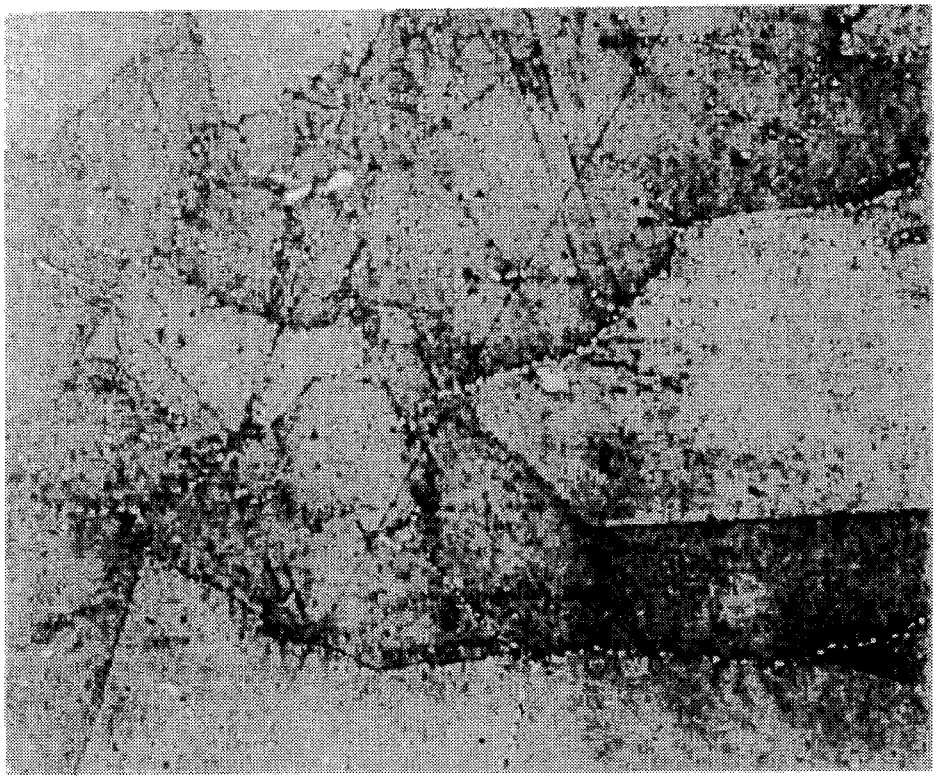
FIG. 5B illustrates a microstructure, unacceptable for use in hydrogen-containing environments, similar to FIG. 5A except the sample is coarser grained and has less overaging. There is heavy precipitate decoration on grain and twin boundaries. The etchant is sulfide stain; 500× magnification.
Figure 6A:
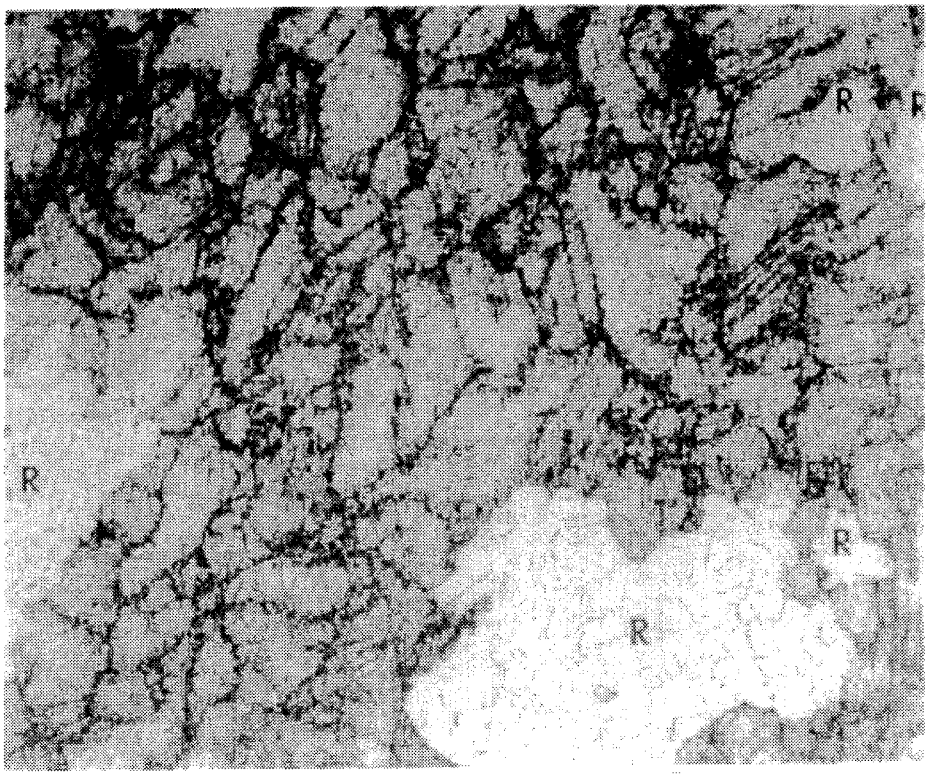
FIG. 6A illustrates a microstructure, unacceptable for use in hydrogen-containing environments, exhibiting predominantly unrecrystallized overaged grains (dark etching areas) and intermittent recrystallized grains (R). The etchant is Kallings; 200× magnification.
Figure 6B:
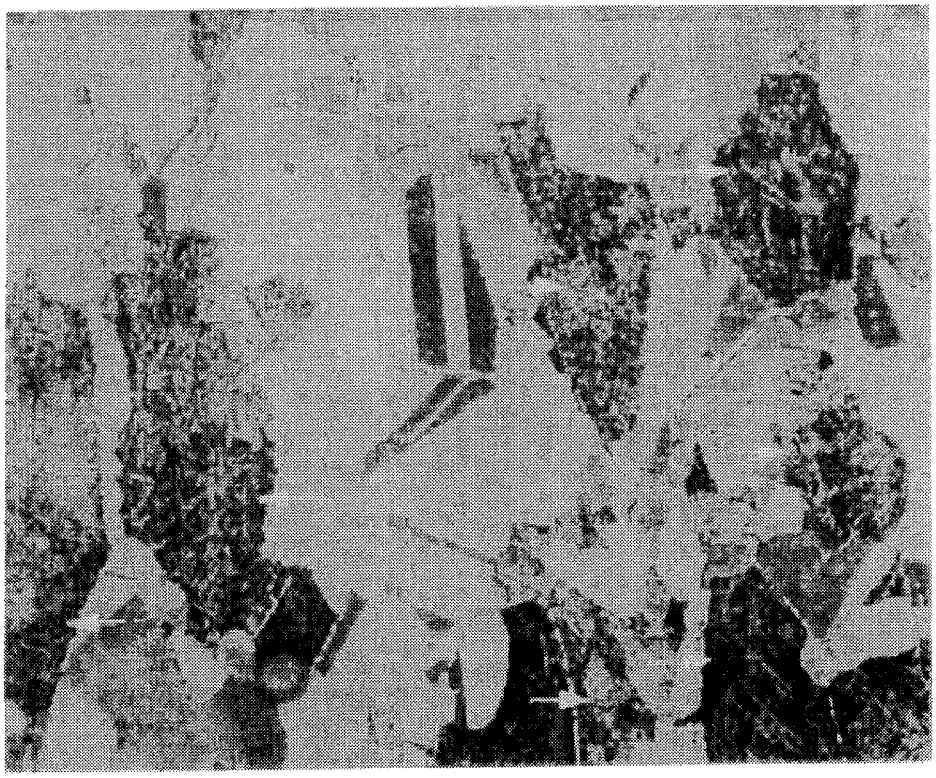
FIG. 6B illustrates a microstructure, unacceptable for use in hydrogen-containing environments, exhibiting heavy grain boundary decoration by precipitate particles. The microstructure contains predominantly recrystallized grains with intermittent unrecrystallized overaged grains (arrows). The etchant is sulfide stain; 500× magnification.

Microstructure:

The preferred microstructure consists of predominantly recrystallized grains with minimal precipitate decorating grain boundaries and twin boundaries. FIGS. 1–6 provide examples of acceptable and unacceptable microstructure in hydrogen containing environments at elevated temperatures.

EXAMPLE 1

An inlet labyrinth seal composed of INCOLOY™ 909 was forged using 1600° F. for all operations. The forging was then heated to 1850°±25° F. for an hour and cooled at a rate equivalent to air cool (about 40° F./min; heavier sections may require fan cooling) The part was then aged by heating to 1325°±25° F. holding for 8 hours, furnace cooling at a rate of 100°±25° F. per hour to 1150°±25° F. and held at 1150°±25° F. for 8 hours, followed by air cool to room temperature. Tests of the resulting superalloy revealed the following properties: at room temperature the yield strength was 162 ksi and the ultimate strength was 202 ksi with 14% elongation and 31% reduction in area. A rupture test of a notch specimen exhibited 114 hours life at 1000° F. and 70 ksi in 65% relative humidity air. Tests were conducted as described above unless otherwise noted. The superalloy exhibited highly uniform grains with grain size of ASTM 8.5.

EXAMPLE 2

A comparative treatment was conducted in which the recrystallization treatment was avoided. The superalloy was forged as in Example 1 and cooled to room temperature. The superalloy was then heated to 1325°±25° F. for about 8 hours, furnace cooled at a rate of 100°±25° F. per hour to 1150°±25° F. and held at this temperature for 8 hours, followed by air cooling. The resulting alloy exhibited a yield strength of 100 ksi and an ultimate strength of 155 ksi at room temperature with 13% elongation and a 31% reduction in area. Rupture occurred at 2.9 hours in moist air at 1200° F. and 74 ksi with 33% elongation.

EXAMPLE 3

A turbine bellows composed of INCOLOY™ 909 was forged using 1600° F. heating for all operations. The forging was then heat treated at 1850° F.±25° F. for an hour and fan air cooled. The part was then overaged by heating to 1375°±25° F. for 4 hours, furnace cooled at 100° F./hour to 1150° F. and held at 1150°±25° F. for 8 hours followed by air cooling. Tests on the resulting superalloy revealed the following properties: at room temperature the yield strength was 146 ksi and the ultimate strength was 190 ksi with 19% elongation and 33% reduction in area; at 1200° F. the yield strength was 127 ksi with an ultimate strength of 147 ksi and 24% elongation and 62% reduction in area; a rupture test of a notch specimen exhibited 191 hours life at 1000° F. at 70 ksi in 65% relative humidity air.

EXAMPLE 4

Starting with a 6" diameter billet of INCOLOY™ 909, weighing 58 lbs, and using 1600° F. heating (reheating) for all operations, the billet was worked to a final shape in the following sequence:

End upset to 4" tall and crosswork to a rectangular solid 4.75"×4.75". Reheat.

Break corners (i.e. flatten or press corners) to form a 5.25" diameter round bar and upset (compress) to 4" tall. Reheat.

Repeat crosswork to 4.75" square. Reheat.

Break corners and upset to 6" tall. Reheat.

End upset to 4.2" tall. Reheat.

Punch, edge up to maintain cylindrical shape and shear 3.25" diameter hole. Reheat.

Finish part size 8.47" OD×4.43" ID×1.82" tall.

Saddle forge to form ring.

Heat treat as in Example 1 and cut away test material.

This process yielded a part with the properties shown below:

Grain size ASTM 8, 100% recrystallized.

Stress Rupture at 1000° F. 70 ksi in humid air, combination smooth/notch bar (see ASTM E292). 87.9 hours life, notch break.

| Temp | Yield, ksi | Ultimate, ksi | % el | % RA |
|---|---|---|---|---|
| RT | 165 | 203 | 15 | 30 |
| 1200 F. | 138 | 160 | 25 | 64 |

EXAMPLE 5

Starting with a 6" diameter billet of INCOLOY™ 909, weighing 93 lbs, and using 1600° F. heating for all operations, the billet was worked to a final shape in the following sequence:

Upset and crosswork to 4.5" square. Reheat.

Break corners and round up sides to 5" diameter. Reheat.

Upset and edge up sides to 13.75" tall. Reheat.

Continue upset and edge to 10.5" tall. Reheat.

Continue upset and edge to 4" tall. Reheat as necessary.

Heat treat as in Example 1.

This process yielded a part with the properties shown below:

Grain size ASTM 8, 100% recrystallized.

Stress Rupture at 1000° F., 70 ksi in humid air, combination smooth/notch bar.

| 40 hours life, notch break. | | | | |
|---|---|---|---|---|
| Temp | Yield, ksi | Ultimate, ksi | % el | % RA |
| RT | 159 | 198 | 16 | 37 |
| 1200 F. | 139 | 140 | 21 | 56.8 |

EXAMPLE 6 (Comparative Example)

Starting with a 8" diameter billet of INCOLOY™ 909, weighing 410 lbs, and using 1875° F. heating for all operations, the billet was worked to a final shape in the following sequence:

Upset and edge to 9.5" octagon. Reheat.

Upset and edge to 10.0" tall and punch. Reheat.

Saddle forge and flatten ends to 14.5 OD×6.375 ID×10.25 tall. Reheat as necessary.

The finished piece was solution annealed at 1800° F. for 1 hour and age strengthened as described in Example 1.

| Temp | Yield, ksi | Ultimate, ksi | % el | % RA |
|---|---|---|---|---|
| RT | 151 | 184 | 8 | 13.1 |
| 1200 F. | 117 | 162 | 17 | 49.5 |

Grain size ASTM 4, 100% unrecrystallized.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

We claim:

1. A method of making a low expansion Fe—Ni—Co superalloy having a substantially uniform microstructure, comprising the steps of:

a) warm forging a low expansion Fe—Ni—Co superalloy at a temperature below that needed to recrystallize said Fe—Ni—Co superalloy; said temperature being between about 1200° F. to about 1700° F.; and b) recrystallizing said material at a temperature between about 1800° F. to about 1950° F.;

wherein said warm forging step introduces sufficient strain throughout said Fe—Ni—Co superalloy such that after said recrystallizing step said Fe—Ni—Co superalloy has a substantially uniform microstructure.

2. The method of claim 1 further comprising a precipitation heat treatment step following said recrystallizing step.

3. The method of claim 2 wherein said step of recrystallizing comprises heating at about 1850° F. for about 1 hour followed by cooling at a rate about equal to air cooling.

4. The method of claim 3 wherein said precipitation heat treatment step comprises heating the superalloy to about 1325° F. for about 8 hours and about 1150° F. for about 8 hours.

5. The method of claim 3 wherein said precipitation heat treatment step comprises heating the superalloy to about 1375° F. for about 4 to 8 hours and about 1150° F. for about 8 hours.

6. The method of claim 2 wherein said alloy contains a high temperature precipitate phase and further wherein said recrystallizing step does not fully recrystallize said superalloy such that after said precipitation heat treatment the high temperature precipitate phase is not uniformly dispersed in said superalloy.

7. The method of claim 2 wherein said alloy contains a high temperature precipitate phase and further wherein said recrystallizing step fully recrystallizes said superalloy such that after said precipitation heat treatment the high temperature precipitate phase is substantially uniformly dispersed in said superalloy.

8. The method of claim 7 wherein said precipitation heat treatment step comprises heating the superalloy to about 1325° F. for about 8 hours and about 1150° F. for about 8 hours.

9. The method of claim 2 wherein said forging step comprises multiple forging operations which are not separated by annealing steps.

10. The method of claim 2 wherein after said forging step, said superalloy has been strained at least 30%.

11. The method of claim 2 wherein said forging step is conducted between 1550° F. and 1650° F.

12. The method of claim 2 wherein said Fe—Ni—Co superalloy consists essentially of:

| | min | max |
|---|---|---|
| Carbon | — | 0.06 |
| Manganese | — | 1.00 |
| Silicon | 0.25–0.50 | |
| Phosphorus | — | 0.015 |
| Sulfur | — | 0.015 |
| Nickel | 35.00–40.00 | |
| Cobalt | 12.00–16.00 | |
| Columbium + Tantalum | 4.30–5.20 | |
| Titanium | 1.35–1.80 | |
| Boron | — | 0.012 |
| Chromium | — | 1.00 |
| Aluminum | — | 0.15 |
| Copper | — | 0.50 |
| Iron | remainder. | |

13. The method of claim 8 wherein said superalloy consists essentially of the nominal composition: 38% nickel, 13% cobalt, 42% iron, 4.7% niobium, 1.5% titanium, 0.4% silicon, 0.03% aluminum, and 0.01% carbon.

14. The method of claim 12 wherein said forging step is conducted between 1550° F. and 1650° F. and wherein said step of recrystallizing comprises heating at about 1850° F. for about 1 hour followed by cooling at a rate about equal to air cooling.

15. The method of claim 14 wherein said precipitation heat treatment step comprises heating the superalloy to about 1325° F. for about 8 hours and about 1150° F. for about 8 hours.

16. The method of claim 14 wherein said precipitation heat treatment step comprises heating the superalloy to about 1375° F. for about 4 to 8 hours and about 1150° F. for about 8 hours.

17. The superalloy made by the process of claim 1 wherein said superalloy consists essentially of the following elements:

| | min | max |
|---|---|---|
| Carbon | — | 0.06 |
| Manganese | — | 1.00 |
| Silicon | 0.25–0.50 | |
| Phosphorus | — | 0.015 |
| Sulfur | — | 0.015 |
| Nickel | 35.00–40.00 | |
| Cobalt | 12.00–16.00 | |
| Columbium + Tantalum | 4.30–5.20 | |
| Titanium | 1.35–1.80 | |
| Boron | — | 0.012 |
| Chromium | — | 1.00 |
| Aluminum | — | 0.15 |
| Copper | — | 0.50 |
| Iron | remainder. | |

18. A low expansion Fe—Ni—Co superalloy article having a substantially uniformly dispersed precipitate phase and having a grain size which is continuously uniform without pronounced segregation of fine and coarse areas at various locations in said article, and consisting essentially of the following elements:

| | min | max |
|---|---|---|
| Carbon | — | 0.06 |
| Manganese | — | 1.00 |
| Silicon | 0.25–0.50 | |
| Phosphorus | — | 0.015 |
| Sulfur | — | 0.015 |
| Nickel | 35.00–40.00 | |
| Cobalt | 12.00–16.00 | |
| Columbium + Tantalum | 4.30–5.20 | |
| Titanium | 1.35–1.80 | |
| Boron | — | 0.012 |
| Chromium | — | 1.00 |
| Aluminum | — | 0.15 |
| Copper | — | 0.50 |
| Iron | remainder. | |

19. The article of claim 18 having stress rupture properties defined by ATSM E292 wherein said article resists rupture for at least 32 hours at 1000° F. with an axial stress of 70 ksi in air having a relative humidity of 60–70% in the temperature range of 70°–80° F.

20. The article of claim 18 having a high temperature precipitate phase that is substantially uniformly dispersed throughout said superalloy.

21. The article of claim 20 having a yield strength at room temperature of at least 140 ksi and an elongation at room temperature of at least 8%.

22. The article of claim 21 wherein said superalloy forms a component in a gas turbine engine or a rocket engine turbopump.

23. A process of creating uniform grain size and uniformly dismersed precipitate particles in an Fe—Ni—Co superalloy comprising the steps of:

a) warm forging a low expansion Fe—Ni—Co superalloy at a temperature below that needed to recrystallize said Fe—Ni—Co superalloy; said temperature being between about 1200° F. to about 1700° F.; and b) recrystallizing said material at a temperature between about 1800° F. to about 1950° F.;

wherein said warm forging step introduces sufficient strain throughout said Fe—Ni—Co superalloy such that after said recrystallizing step said Fe—Ni—Co superalloy has a substantially uniform microstructure and a substantially uniformly dispersed precipitate phase.

* * * * *